US005608430A

United States Patent [19]

Jones et al.

[11] Patent Number: 5,608,430

[45] Date of Patent: Mar. 4, 1997

[54] PRINTER PRINT HEAD POSITIONING APPARATUS AND METHOD

[75] Inventors: Michael E. Jones, Portland; Randy C. Karambelas, Milwaukie, both of Oreg.

[73] Assignee: Tektronix, Inc., Wilsonville, Oreg.

[21] Appl. No.: 300,020

[22] Filed: Sep. 2, 1994

Related U.S. Application Data

[63] Continuation-in-part of Ser. No. 206,998, Mar. 7, 1994, Pat. No. 5,488,396.

[51] Int. Cl.[6] ..... B41J 25/308

[52] U.S. Cl. ..... 347/8; 400/59

[58] Field of Search ..... 347/8, 19, 20, 347/103; 400/59

[56] References Cited

U.S. PATENT DOCUMENTS

| | | | |
|---|---|---|---|
| 4,538,156 | 8/1985 | Durkee et al. | 346/21 |
| 4,843,338 | 6/1989 | Rasmussen et al. | 400/55 |
| 4,952,084 | 8/1990 | Maruyama | 400/120 |
| 4,990,004 | 2/1991 | Kawahara et al. | 400/56 |
| 5,000,590 | 3/1991 | Einem | 400/55 |
| 5,009,526 | 4/1991 | Kirchhof | 400/56 |
| 5,051,008 | 9/1991 | Honda et al. | 400/59 |
| 5,227,809 | 7/1993 | Carpenter et al. | 346/1.1 |
| 5,365,261 | 11/1994 | Ozawa et al. | 347/103 |

OTHER PUBLICATIONS

"Self-Adjusting Forms Thickness Compensation for a Printer," IBM Technical Disclosure Bulletin, vol. 30, No. 8, Jan. 1988, pp. 406 and 407.

"Printhead Adjustment," D. K. Rex, IBM technical Disclosure Bulletin, vol. 26, No. 12, May 1984, pp. 6373 and 6374.

*Primary Examiner*—Benjamin R. Fuller
*Assistant Examiner*—Craig A. Hallacher
*Attorney, Agent, or Firm*—Ralph D'Alessandro; Richard B. Preiss

[57] ABSTRACT

A print head (216) tilt angle positioner (258) includes a scroll cam (344), a tilt arm (332), a flexure (334), a tilt angle adjuster (336), and a biasing spring (338). The tilt arm and the print head are attached to a shaft (220) that rotates the tilt arm and the print head together between printing, maintenance, and shipping tilt angle positions to control the distance of the print head from the image receiving drum.

28 Claims, 11 Drawing Sheets

PRINTER PRINT HEAD POSITIONING APPARATUS AND METHOD

RELATED APPLICATIONS

This application is a continuation-in-part of U.S. Pat. application Ser. No. 08/206,998 filed Mar. 7, 1994, now U.S. Pat. No. 5,488,396, issued Jan. 30, 1996

TECHNICAL FIELD

This invention relates to printers of a type having a print head and an image-receiving surface that move relative to each other and more particularly to an apparatus and method for spacing the print head apart from the image-receiving surface at respective printing and print head maintaining distances.

BACKGROUND OF THE INVENTION

Many computer printers, including some low-resolution ink-jet printers, scan a print head back and forth relative to a print medium to print graphics and text images thereon. Printing typically occurs while the print head is scanned in each direction, thereby employing relatively fast bidirectional printing.

An ink-jet printer ejects ink drops from the print head onto the print medium to form a printed image. The print head is typically spaced apart from the print medium, and the droplets are ejected toward the print medium at a relatively low velocity. Accordingly, there is a propagation time during which the droplets travel from the print head to the print medium. The propagation time is dependent upon the velocity at which the droplets are ejected from the print head and the distance between the print head and the print medium.

The print head and print medium move relative to each other at a scanning velocity. A droplet ejected from the moving print head will have the scanning velocity in the direction the print head is being moved. A droplet projected toward an image location on the print medium must, therefore, be ejected from the print head at an ejection time that occurs before the print head is aligned with the image location. Nominally, the ejection time precedes the alignment of the print head with the image location by about the propagation time of the droplet.

When printing takes place in only one scan direction, all droplets are subjected to the same scanning velocity. As a result, the alignment of droplets ejected during successive scans is substantially independent of the propagation time of the droplets.

In bidirectional printing, however, droplets are subjected to different scanning velocities during the successive scans in opposite directions. As a result, the alignment of droplets ejected during successive scans is dependent upon the propagation time of the droplets (i.e., the velocity at which the droplets are ejected from the print head and the distance between the print head and the print medium). Therefore, unidirectional printing provides potentially greater printing quality, albeit at a loss of printing speed.

The droplet ejection velocity can be regulated by the print head. Accordingly, the distance between the ink-jet print head and the print medium must be accurately maintained to provide adequate alignment of the droplets ejected during successive scans in opposite directions.

High-resolution ink-jet printers can form images with ink drops spaced apart by about 120 dots per centimeter. Maintaining such resolution requires that the distance between the print head and print medium be maintained within a tolerance of about ±0.05 millimeter. However, such printers are sometimes adapted to print onto media having a wide range of thicknesses, creating a drop alignment problem for bidirectional printing.

Prior workers have devised various techniques for maintaining the distance between the print head and the print medium. For example, U.S. Pat. No. 4,843,338 issued Jun. 27, 1989 for INK-JET PRINTHEAD-TO-PAPER REFERENCING SYSTEM, "Self-Adjusting Forms Thickness Compensation for a Printer, " IBM Technical Disclosure Bulletin, January 1988, and "Printhead Adjustment, " IBM Technical Disclosure Bulletin, May 1984, all describe spacing mechanisms in which a contact slides or rolls on the print medium to establish a predetermined print head-to-print medium spacing. Unfortunately, such spacing mechanisms introduce undesirable friction, are susceptible to surface irregularities, and generally introduce visible printing artifacts in high-resolution printing applications. They are also susceptible to mechanical shock-damage, such as that encountered in shipping.

Therefore, noncontacting spacing techniques were also devised. FIG. 1 shows a reciprocating printer example that is described in U.S. Pat. No. 5,227,809 issued Jul. 13, 1993 for AUTOMATIC PRINT HEAD SPACING MECHANISM FOR INK-JET PRINTER, assigned to the assignee of this application. An ink-jet printer 10 requires about two minutes to print a 120-dot-per-centimeter color image. An ink-jet print head assembly 12 supports a print head 14 having 96 orifices from which ink droplets are ejected toward a print medium 16 that is mounted on a drum 20. Print medium 16 is fed through a pair of media feed rollers **22*a* and 22*b* and secured to drum 20 by a media securing system 24. Securing system 24 includes a media clamp 26 that receives and clamps a leading end of print medium 16 against drum 20. Media clamp 26 slides into and remains stationary within a slot 28 in drum 20**.

A drum motor (not shown) incrementally rotates drum 20 in a direction 34 about an axis 36 of drum 20, thereby pulling print medium 16 through media feed rollers **22*a* and 22*b* and under a back tension blade 38 that is spring biased toward drum 20. Print medium 16 slides under and is held against drum 20 by back tension blade 38 as drum 20** rotates.

A print head lateral positioning system 50 includes a carriage 52 slidably mounted on a pair of guide rails **54*a* and 54*b* and supporting print head assembly 12. A carriage drive belt 56 is attached to carriage 52 and held under tension by a pair of belt pulleys 58*a* and 58*b*. A carriage stepper motor 60 linked to pulley 58*a* drives carriage 52 in directions 62*a* and 62*b* along guide rails 54*a* and 54*b***.

When printing images on print medium 16, the drum motor incrementally rotates drum 20 about axis 36 while carriage motor 60 bidirectionally drives carriage 52 along guide rails **54*a* and 54*b* and a printer controller 70 delivers print control signals to a control input 72 of print head 14, which ejects ink droplets toward print medium 16. The print control signals are delivered to print head 14 while carriage 52 is driven in both directions 62*a* and 62*b*, thereby providing bidirectional printing in which successive bands of image lines are printed alternately in directions 62*a* and 62*b* by the multiple nozzles of print head 14**.

A spacing mechanism 74 automatically provides the predetermined separation distance between print medium 16 and print head 14. During a spacing calibration process, back tension blade 38 is pressed against print head 14 to push it away from print medium 16 by the predetermined separation distance. Carriage 52 has a fixed-length coupling to front guide rail 54*b*, and spacing mechanism 74 provides an extendable coupling 76 that varies the distance between rear guide rail 54*a* and carriage 52. Varying the effective length of extendable coupling 76 causes the carriage to pivot about front guide rail 54*b* to position print head 14 at the predetermined separation distance.

Printer 10 suffers from a number of disadvantages including a complex print medium handling mechanism, susceptibility to bidirectional dot misconvergence, and a relatively slow printing speed. Moreover, spacing mechanism 74 does not provide sufficient spacing to provide maintenance access to print head 14. Therefore, guide rails 54 and lateral positioning mechanism 50 are lengthened to allow print head assembly 12 to be positioned beyond an end of drum 20 for access to print head 14. Unfortunately, this unduly increases the physical size, weight, and complexity of printer 10 without reducing its susceptibility to shipping damage.

Printing speed can be increased by increasing the number of nozzles in print head 14, but even with 124 nozzles, printer 10 still requires about one minute to print an image. Printing speed can also be increased by increasing the velocity at which carriage 52 reciprocates back and forth in directions 62*a* and 62*b*. However, drop convergence problems increase with carriage speed, and lateral positioning accuracy decreases because of dynamic positioning problems associated with rapidly moving the relatively massive ink-jet print head assembly 12.

For the above-described reasons, a transfer printing process similar to the one described in U.S. Pat. No. 4,538,156 issued Aug. 27, 1985 for INK-JET PRINTER is desirable for increasing printing speed, eliminating bidirectional convergence problems, and reducing paper path complexity. A transfer printer employs a print media-width print head that ejects image-forming droplets directly onto a rotating drum. After the drum is "printed, " a print medium is placed in rolling contact with the drum such that the image is transferred from the drum to the print medium. In transfer printing, the spacing between the print head and the image-receiving drum does not depend on the thickness of the print medium and is, therefore, typically set at a fixed distance.

FIG. 2 shows that the transfer printer includes a transfer drum 80 rotated by a motor 82 in a direction indicated by an arrow 84. A print head assembly 86 includes a frame 88, guide rails 90 and 92, a nozzle array 94, a stepper motor 96, a belt 98, and a lateral positioning assembly 100. An ink reservoir 102 is connected to nozzle array 94 by a tube 104. The positioning and spacing of print head assembly 86 relative to transfer drum 80 is established by frame 88 and guide rails 90 and 92.

The transfer printer also includes a print media supply surface 106, a printing pressure roller 108, and a drum cleaning assembly 110. A drum-cleaning web 112 and transfer drum 80 are brought into contact by a roller 114 that is moved toward transfer drum 80 in proper time relationship with the movement of printing pressure roller 108. Cleaning web 112 prepares the surface of transfer drum 80 to receive the ink drops from nozzle array 94.

Nozzle array 94 is a print media-width linear array of spaced apart nozzles that print a 79-dot-per-centimeter resolution image on drum 80 during 20 successive rotations of transfer drum 80. The image on transfer drum 80 is transferred when a print medium 115 is advanced into a nip formed between printing pressure roller 108 and transfer drum 80.

Transfer drum 80, print head assembly 86, and drum-cleaning assembly 110 are mounted between two frame plates of which only a right-hand plate 116 is shown.

FIG. 3 shows lateral positioning assembly 100 in greater detail. Stepper motor 96 incrementally moves print head assembly 86 to access successive printing tracks on transfer drum 80. Thereby, nozzle array 94 is moved laterally on guide rails 90 and 92 by lateral motion assembly 100. The rotation of stepper motor 96 is transferred to a shaft 120 by belt 98 and a pulley 122. Threads 124 on shaft 120 engage internal threads 126 on a nut 128. Nut 128 and a body 130 are held in a fixed relationship by splines (not shown) and by a spring 132.

The printing tracks on transfer drum 80 are successively accessed by energizing stepper motor 96 for a predetermined number of steps sufficient to achieve the desired lateral motion of the print head assembly 86. After each nozzle of nozzle array 94 has printed all tracks of a corresponding succession of tracks, stepper motor 96 is reversed to cause body 130 and print head assembly 86 to return to an initial printing position. A return spring 134 cooperates with spring 132 to ensure accurate positioning of nozzle array 94 by eliminating play in the meshing of threads 124 on shaft 120 with internal threads 126 on nut 128. Body 130 of lateral motion assembly 100 is moved laterally on guide rails 136 and 138. Lateral movement of body 130 is coupled by a pin 140 to a tab 142 that is attached to print head assembly 86.

The above-described transfer printer is advantageous because of rapid unidirectional printing, constant print head to media spacing, insensitivity to print media thickness, and a greatly simplified "straight through " paper path.

However, lateral motion assembly 100 is relatively complex and is unable to accurately position a print head assembly with a nozzle array capable of printing high-resolution images. Moreover, because print head assembly 86 is media width and is constrained by guide rails 90 and 92, it cannot be moved laterally or away from transfer drum 80 a sufficient distance to provide maintenance access to nozzle array 94.

What is needed, therefore, is a print head assembly positioner that is simple and adjustable, has minimal friction and backlash, can position the print head for maintenance, can help prevent shipping damage, and supports high-resolution printing without visible printing artifacts.

SUMMARY OF THE INVENTION

An object of this invention is, therefore, to provide an apparatus and a method for accurately, repeatably, and reliably positioning a print head assembly relative to a print medium.

Another object of this invention is to provide a simple, adjustable, and relatively friction- and backlash-free apparatus and method for positioning a print head assembly relative to a print medium.

A further object of this invention is to provide an apparatus and a method for positioning a print head assembly relative to a print medium such that high-resolution printing is achieved without visible print banding or other print artifacts.

Still another object of this invention is to provide a print head positioning apparatus and method providing print head-to-image-receiving spacings suitable for printing, print head maintenance, and shipping.

Accordingly, a print head tilt angle positioner includes a scroll cam, a tilt arm, a flexure, a tilt angle adjuster, and a biasing spring. The tilt arm and the print head are attached to a shaft that rotates the tilt arm and the print head together between printing, maintenance, and shipping tilt angle positions. The shaft freely rotates and slides laterally in a pair of shaft bearings. A solenoid pivots a trigger arm away from a stop on the scroll cam to engage a missing tooth gear with a drive gear that subsequently rotates the cam. Attached to one end of the tilt arm is a follower that rides in the scroll cam to provide controlled rotational motion of the tilt arm at all positions except a printing tilt angle. At the printing position, a printing distance is established between the print head and an image-receiving drum by limiting the clockwise rotation of the tilt arm with the flexure. The printing distance is determined by adjusting a distance between the tilt angle adjuster and a post attached to the tilt arm. The post slides in a slot in the flexure for all positions except the printing tilt angle position, at which position the post abuts the end of the slot. The flexure is held in tension by the biasing spring, which removes slack from the system and urges the print head toward the image-receiving drum.

Additional objects and advantages of this invention will be apparent from the following detailed description of a preferred embodiment thereof that proceeds with reference to the accompanying drawings.

DETAILED DESCRIPTION OF PREFERRED EMBODIMENT

Figure 1:
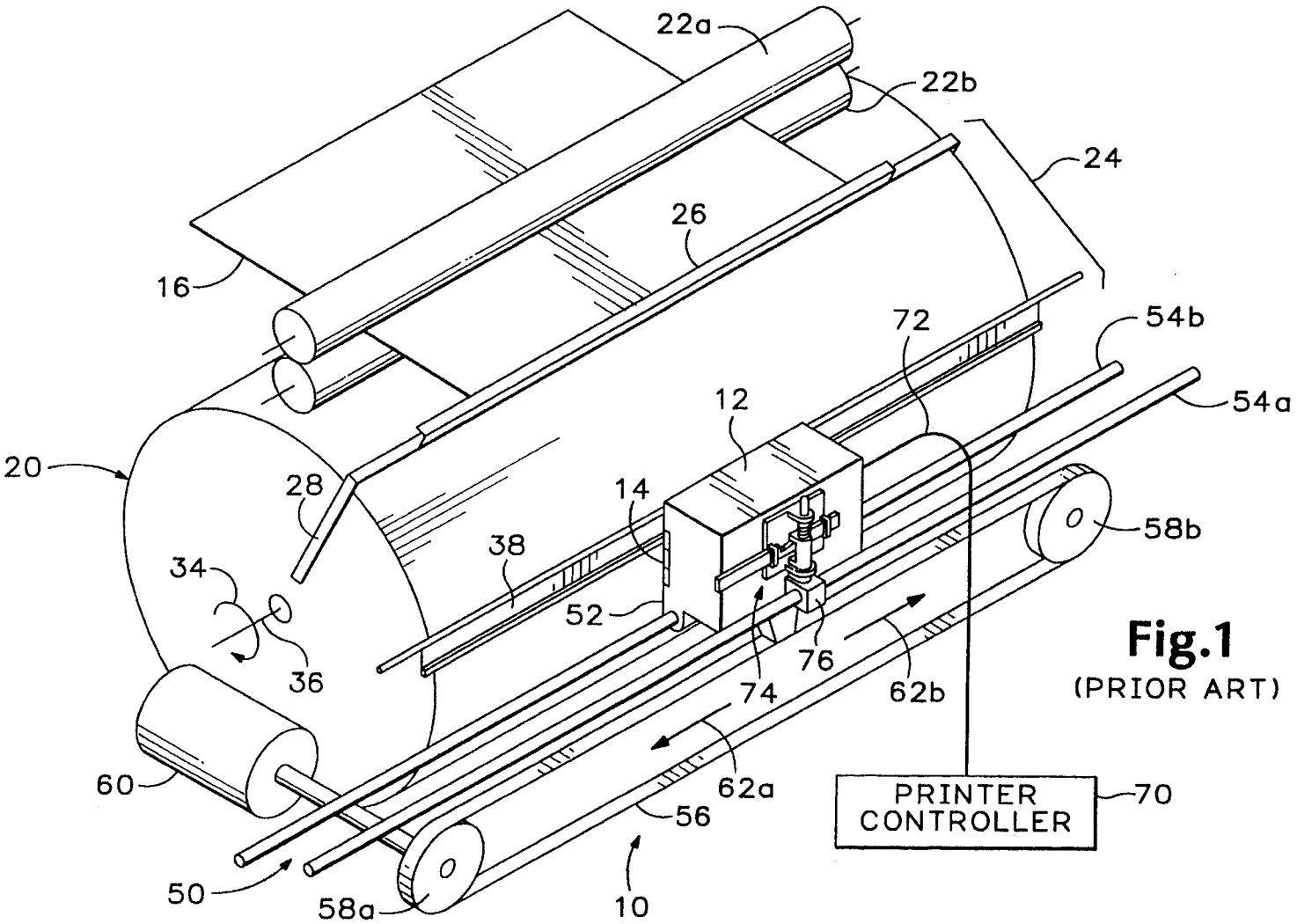
Fig.1 (PRIOR ART)
FIG. 1 is a simplified isometric view of a prior art ink-jet printer showing a print medium support drum and a reciprocating print head positioning system.
Figure 2:
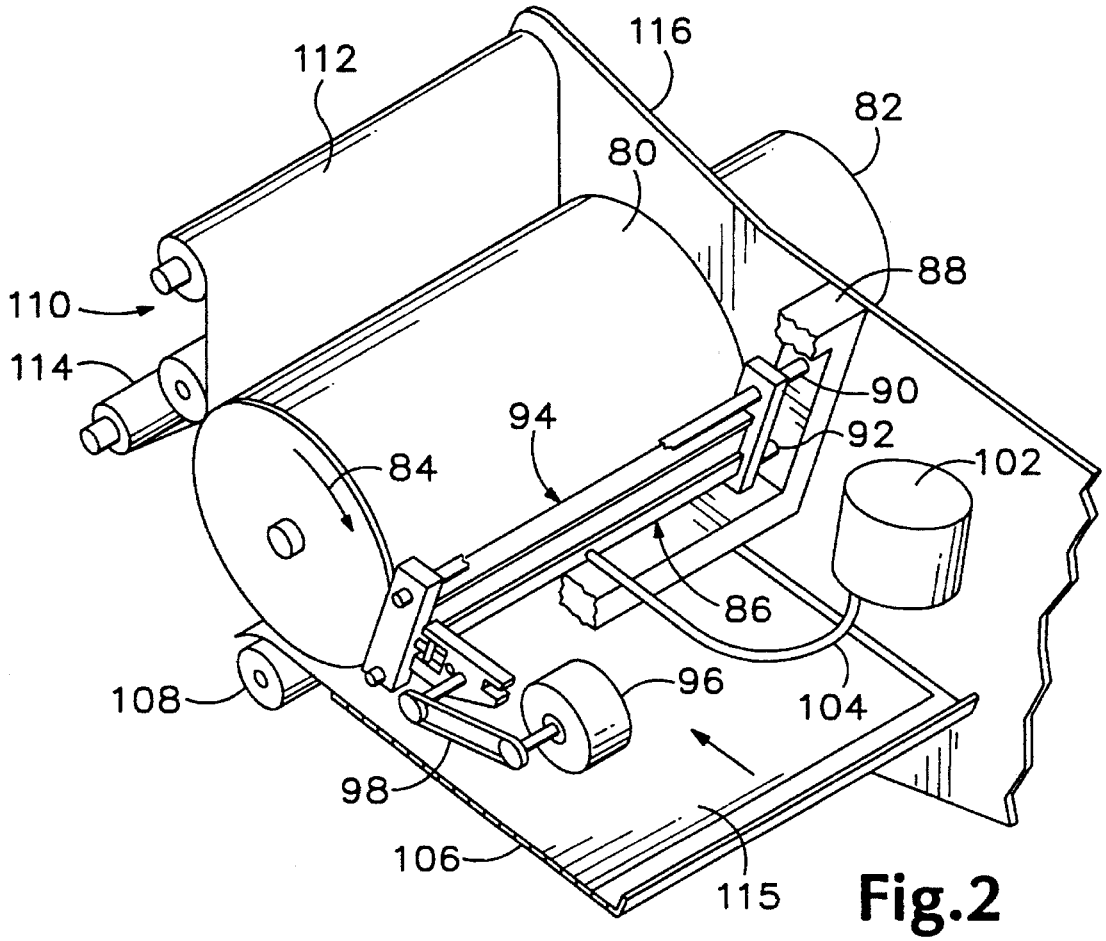
Fig.2 (PRIOR ART)
FIG. 2 is a simplified isometric view of a prior art ink-jet transfer printer showing a transfer drum, a print media-width print head assembly, and a lateral print head positioning system.

The need for precise positioning of a print head assembly relative to a print medium is described below with reference to FIGS. 4A and 4B. An adjacent pair of nozzles 150 and 152 are part of a larger nozzle array, such as nozzle array 94 of FIG. 2. Nozzles 150 and 152 are spaced apart by a predetermined distance that is typically dictated by a desired printing resolution but limited by print head manufacturing capabilities. Therefore, inter-nozzle spacing is typically some integer multiple of the desired printing resolution.

Figure 4A:
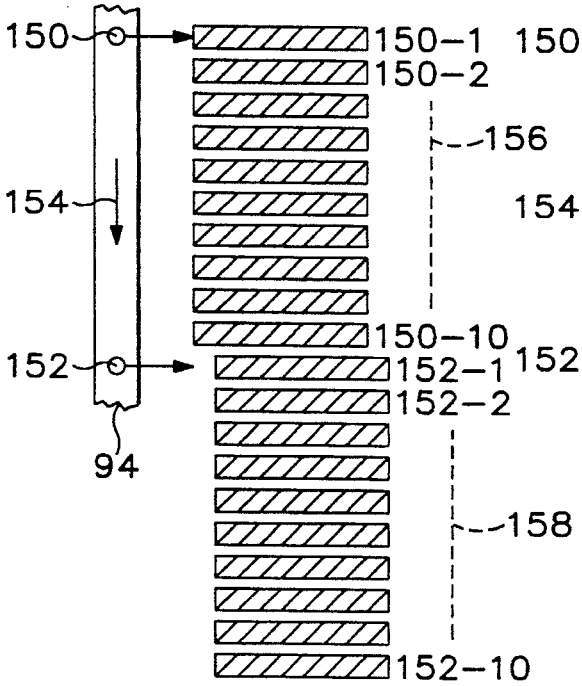
FIGS. 4A and 4B are enlarged schematic pictorial views representing two adjacent ink-jet nozzles moved respectively in properly and improperly proportioned increments to print noninterlaced bands of ink on a moving print medium.

In the example of FIG. 4A, the inter-nozzle spacing is 10 pixel widths. A conventionally scanned transfer printing process entails ejecting ink drops toward the surface of a rotating drum and detecting a rotational index position that is used to start printing on the drum surface at the same angular position for successive rotations of the drum. During a first drum rotation, nozzles 150 and 152 print respective first scan lines 150-1 and 152-1 after which nozzle array 94 is moved exactly one pixel width in a direction indicated by arrow 154. Alternatively and preferably, nozzle array 94 is smoothly moved by one pixel width during the time of each drum rotation. During a second drum rotation, nozzles 150 and 152 print respective second scan lines 150-2 and 152-2 after which nozzle array 94 is again moved exactly one pixel width. This process repeats eight more times until during a tenth drum rotation, nozzles 150 and 152 print respective tenth scan lines 150-10 and 152-10 after which nozzle array 94 is moved back to its original starting position. Finally, the image printed on the drum is transferred to a print medium.

The 10 scan lines printed by nozzle 150 form a first print band 156, and the 10 scan lines printed by nozzle 152 form a second print band 158. Print bands 156 and 158 are shown laterally offset to clearly differentiate them from each other. The lateral offset does not necessarily represent actual printing. As shown in FIG. 4A, when nozzle array 94 is moved in exactly one-pixel increments, the spacing between scan lines equals the spacing between print bands 156 and 158, resulting in uniform printing without a banding artifact.

Figure 4B:
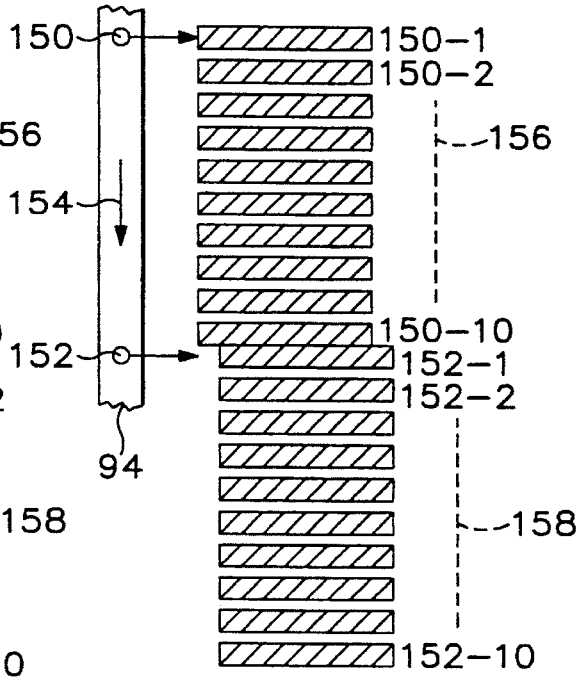

However, FIG. 4B shows what happens when nozzle array 94 is moved slightly more than one pixel per drum rotation. The scan line spacing error accumulates such that scan line 150-10 of first print band 156 overlaps scan line 152-1 of second print band 158. Because the modulation transfer function of the human eye is very sensitive to small lateral displacements, band-to-band spacing errors of only one-tenth of a pixel diameter produce a clearly visible and objectionable "banding" artifact such as the one represented in FIG. 4B. Such banding is repeated across the full width of nozzle array 94 at each neighboring pair of print bands and is visible whether the spacing error causes scan line overlap or underlap.

Figure 5A:
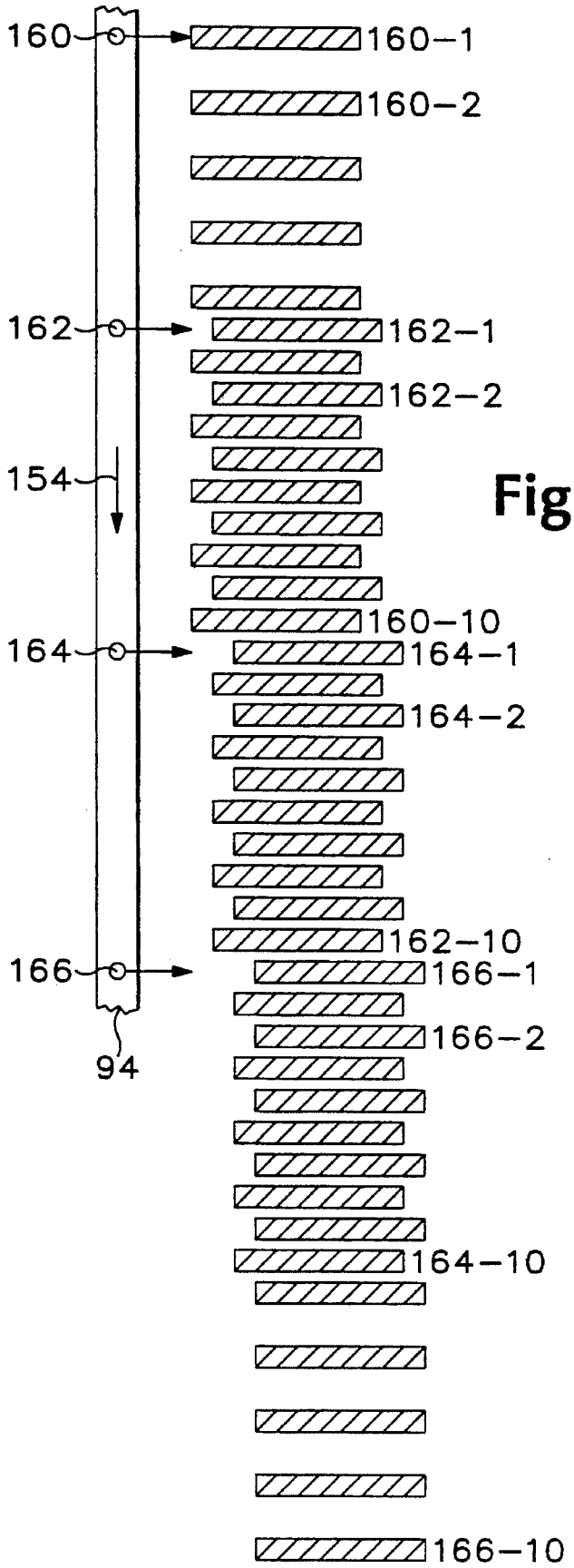
FIGS. 5A and 5B are enlarged schematic pictorial views representing four adjacent ink-jet nozzles moved respectively in properly and improperly proportioned increments to print interlaced bands of ink on a moving print medium.
Figure 5B:
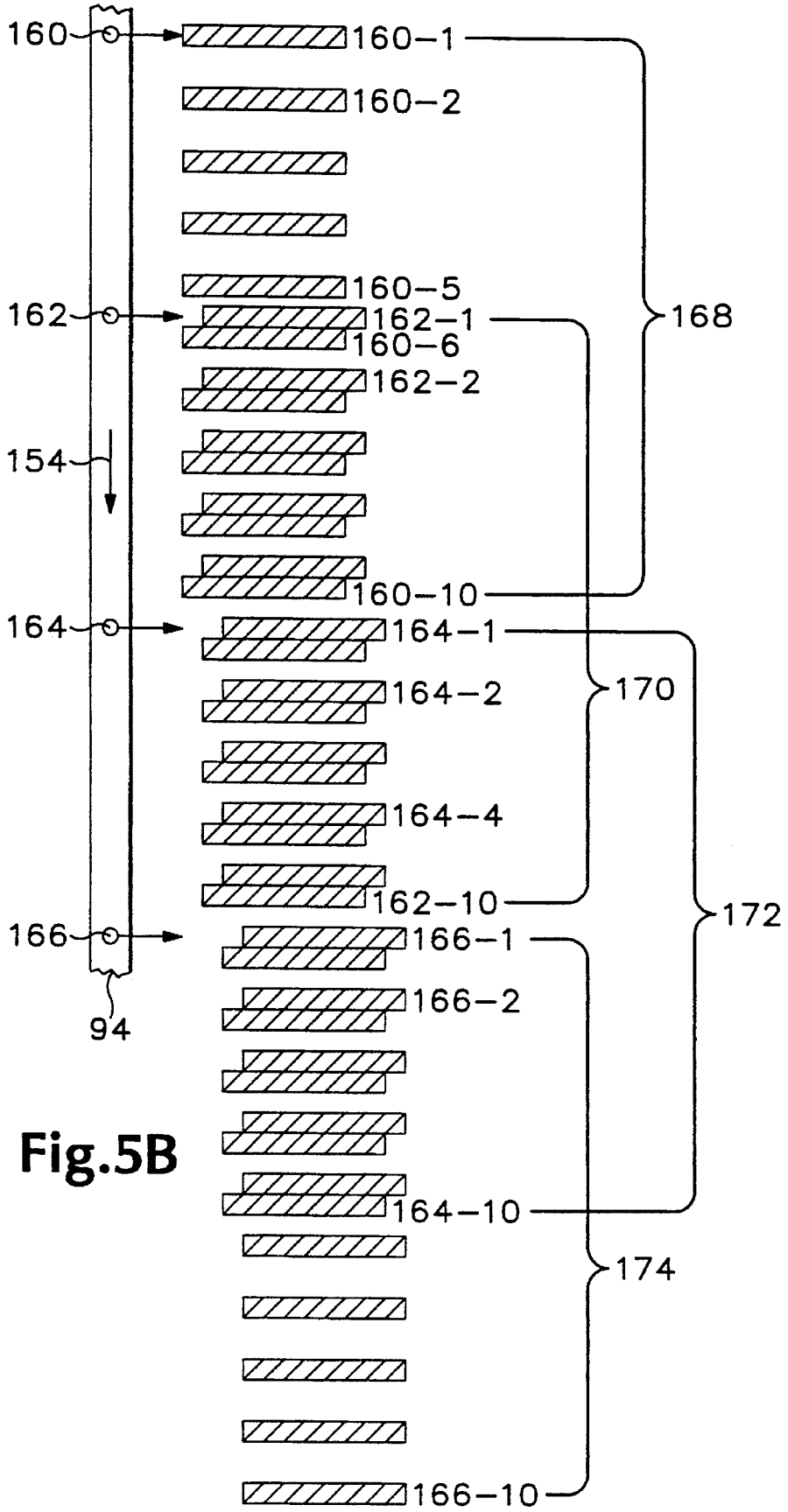

FIGS. 5A and 5B show the effects of proper and improper nozzle array positioning when printing an interlaced image. Interlaced printing is commonly employed in ink-jet printers to allow a first printed set of scan lines to dry or set before an adjacent set of scan lines are printed, thereby preventing the ink of adjacent scan lines from bleeding together.

In the interlaced printing example of FIG. 5A, the inter-nozzle spacing is nine pixel widths. During a first drum rotation, nozzles 160, 162, 164, and 166 print respective first scan lines 160-1, 162-1, 164-1, and 166-1 after which nozzle array 94 is moved exactly two pixel widths in the direction indicated by arrow 154. Alternatively and preferably, nozzle array 94 is smoothly moved by two pixel widths during the time of each drum rotation. During a second drum rotation, nozzles 160, 162, 164, and 166 print respective second scan lines 160-2, 162-2, 164-2, and 166-2 after which nozzle array 94 is again moved exactly two pixel widths. This process repeats eight more times until during a tenth drum rotation nozzles 160, 162, 164, and 166 print respective tenth scan lines 160-10, 162-10, 164-10, and 166-10 after which nozzle array 94 returns to its original starting position.

The 10 successive scan lines printed by nozzles 160, 162, 164, and 166 form respective first through fourth print bands 168, 170, 172, and 174. As in the prior example, the print bands are shown laterally offset to clearly differentiate them from each other. As shown in FIG. 5A, when nozzle array 94 is moved in exactly two-pixel increments, the spacing between interlaced scan lines is equal, even in regions where print bands overlap.

However, FIG. 5B shows the banding artifacts that result when nozzle array 94 is moved slightly less than two pixels per drum rotation. The scan line spacing error accumulates such that scan lines 160-5 and 160-6 of first print band 168 are unevenly spaced apart from scan lines 162-1 and 162-2 of second print band 170. Also, scan line 164-4 of print band 172 overlaps scan line 162-10 of print band 170. Once again, such banding artifacts are repeated across the full width of a nozzle array.

Figure 6:
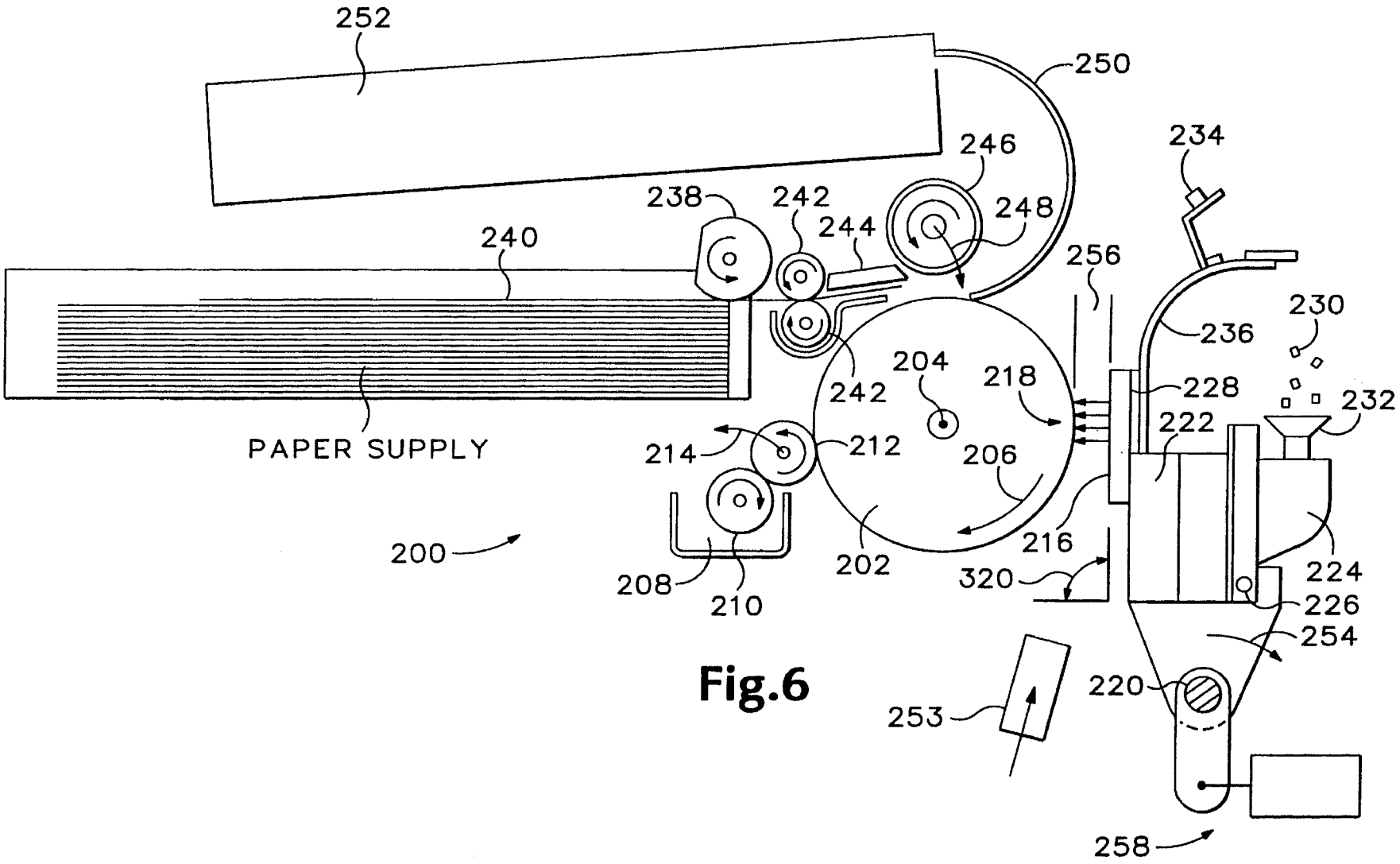
FIG. 6 is a simplified side pictorial view showing an image transfer ink-jet printer, such as one employing this invention.

Referring to FIG. 6, a transfer printing phase-change ink-jet printer 200 (hereafter "printer 200") representative of one employing this invention prints an image according to the following sequence of operations.

A transfer drum 202 rotates about an axis of rotation 204 in a direction indicated by arrow 206. Prior to printing, drum 202 is wetted with a transfer fluid 208 by transfer fluid applicator rollers 210 and 212 after which transfer fluid applicator roller 212 is moved away from drum 202 in the direction of arrow 214. Alternatively and preferably, transfer fluid 208 is selectively applied to drum 202 with a movable wick. An ink-jet print head 216 spans the width of drum 202 with four vertically spaced nozzle arrays (shown generally at 218). Nozzle arrays 218 eject, respectively, yellow Y, magenta M, cyan C, and black K colored phase-change ink. (When necessary hereafter, numbered elements will be further identified by a letter indicating the color of ink carried by the element. For example, nozzle array 218C is a cyan ink ejecting nozzle array.)

Nozzle arrays 218 each have nozzles spaced horizontally by 2.37 millimeters (28×0.0847 millimeter pixel spaces) to provide a 118-dot-per-centimeter printing resolution. Each array of nozzle arrays 218 is aligned parallel with axis of rotation 204, and nozzle arrays 218Y, 218M, and 218C are aligned vertically such that corresponding nozzles in each array print on the same scan line. Nozzle array 218K is offset horizontally by two pixel spaces from corresponding nozzles in the other arrays.

Printing a preferred interlaced image pattern on drum 202 entails moving print head 216 in 27 lateral increments (one during each rotation of drum 202). The 27 increments include 13 two-pixel increments, one three-pixel increment, and 13 more two-pixel increments that together move print head 216 a total lateral distance of 55 pixels (4.656 millimeters), which is two pixels short of the inter-nozzle spacing in order to prevent over-printing a previously printed scan line. The three-pixel print head increment is necessary to provide proper interlacing with the preferred nozzle spacing in print head 216.

Figure 3:
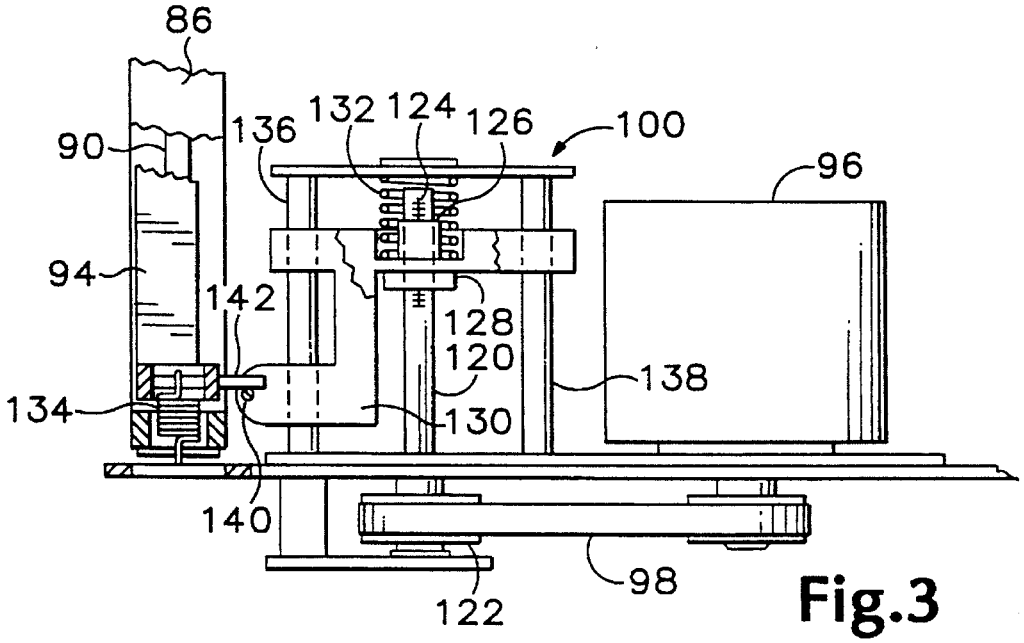
Fig.3 (PRIOR ART)
FIG. 3 is an enlarged top view of the print head positioning system of FIG. 2 showing assembly details of a stepper motor, pulley, belt, lead screw, nut, body, and print head assembly coupling.

In printer 200 a one-tenth pixel positioning error of only eight microns can create visible banding artifacts. Conventional print head positioning mechanisms, such as the lead screw shown in FIG. 3, do not provide the required lateral positioning accuracy or repeatability. Moreover, it is expensive, if not impossible, to design and build mechanical parts that provide better than eight-micron print head positioning accuracy. Therefore, some form of print head positioning scale factor adjustment must be employed by which the fixed angular steps of a stepper motor are converted into adjustably changeable lateral movements of the print head.

The required lateral movement (parallel to axis of rotation 204) is accomplished by securing print head 216 (and associated components) to a shaft 220 that is moved by a print head lateral positioner described with reference to FIGS. 7, 8, and 9.

Print head 216, preferably of a type that ejects phase-change ink, is therefore mounted to an ink reservoir 222 that, together with four ink premelt chambers 224 (one shown), is secured to shaft 220. Reservoir 222 and premelt chambers 224 are heated by a reservoir heater 226, and print head 216 is separately heated by a print head heater 228. Four colors of solid phase-change inks 230 (one representative color shown) are fed through four funnels 232 (one shown) to premelt chambers 224 where solid inks 230 are melted by reservoir heater 226 for distribution to print head 216.

Piezoelectric transducers positioned on print head 216 receive image data from drivers 234 mounted on a flex circuit 236. Print head 216 ejects controlled patterns of cyan, yellow, magenta, and black ink toward rotating drum 202 in response to the image data to deposit a complete image on the wetted surface of drum 202 during 27 rotations of the drum.

A media feed roller 238 delivers a print medium 240 to a pair of media feed rollers 242 that advance print medium 240, such as plain paper or transparency film, past a media heater 244 and into a nip formed between drum 202 and a transfer roller 246. Transfer roller 246 is moved into pressure contact with drum 202 as indicated by an arrow 248. A combination of pressure in the nip and heat from print medium 240 causes the deposited image to transfer from drum 202 and fuse to print medium 240. Image transferring heat is also provided by heating drum 202. Printed print medium 240 advances into an exit path 250 from which it is deposited in a media output tray 252.

After the image transfer is completed, transfer roller 246 moves away from drum 202 and transfer fluid applicator roller 212 moves into contact with and conditions drum 202 for receiving another image.

To maintain print quality, print head 216 requires periodic cleaning and purging by a print head maintenance station 253. Print head maintenance is normally accomplished following cold start-up of printer 200 and proceeds by rotating print head 216 on shaft 220 away from drum 202 in a direction indicated by an arrow 254. When print head 216 is a sufficient distance from drum 202, maintenance station 253 is moved into a position between drum 202 and contacting nozzle arrays 218 of print head 216. Maintenance station 253 is of a type having an elastomeric gasket that surrounds nozzle arrays 218 such that a vacuum seal is established during a purge cycle to draw entrapped bubbles from print head 216. Following the purge cycle, a squeegee blade within maintenance station 253 is slowly drawn in a downward direction across nozzle arrays 218 to wipe excess ink from print head 216. After maintenance, print head maintenance station 253 is withdrawn to the position shown, and print head 216 is rotated back to a printing distance 256 that is determined by a print head tilt angle positioner 258 that is coupled to shaft 220. Print head tilt angle positioner 258 is described further with reference to FIGS. 10–12.

Figure 7:
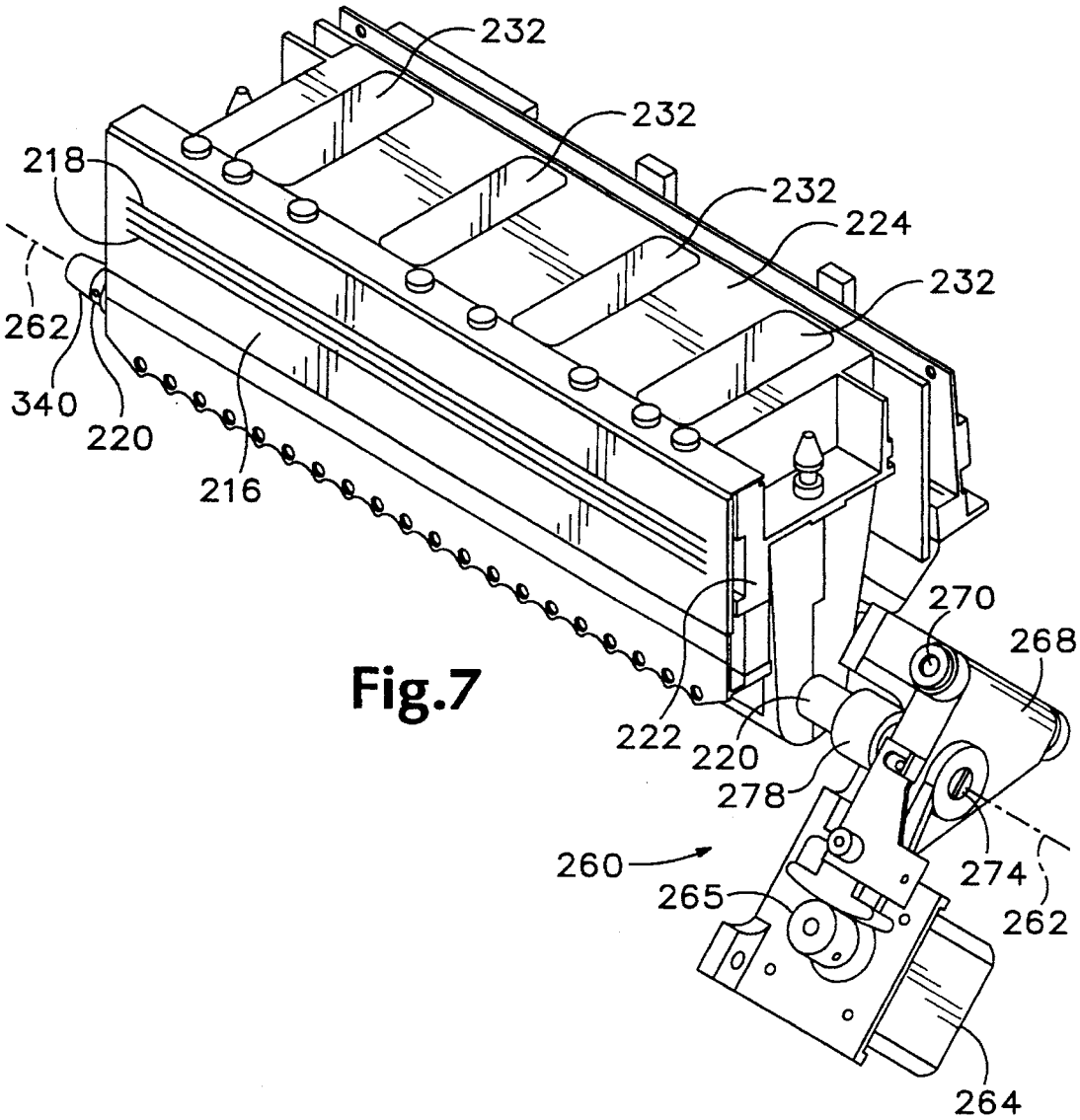
FIG. 7 is an isometric pictorial diagram showing a print head lateral positioning mechanism according to this invention.
Figure 8:
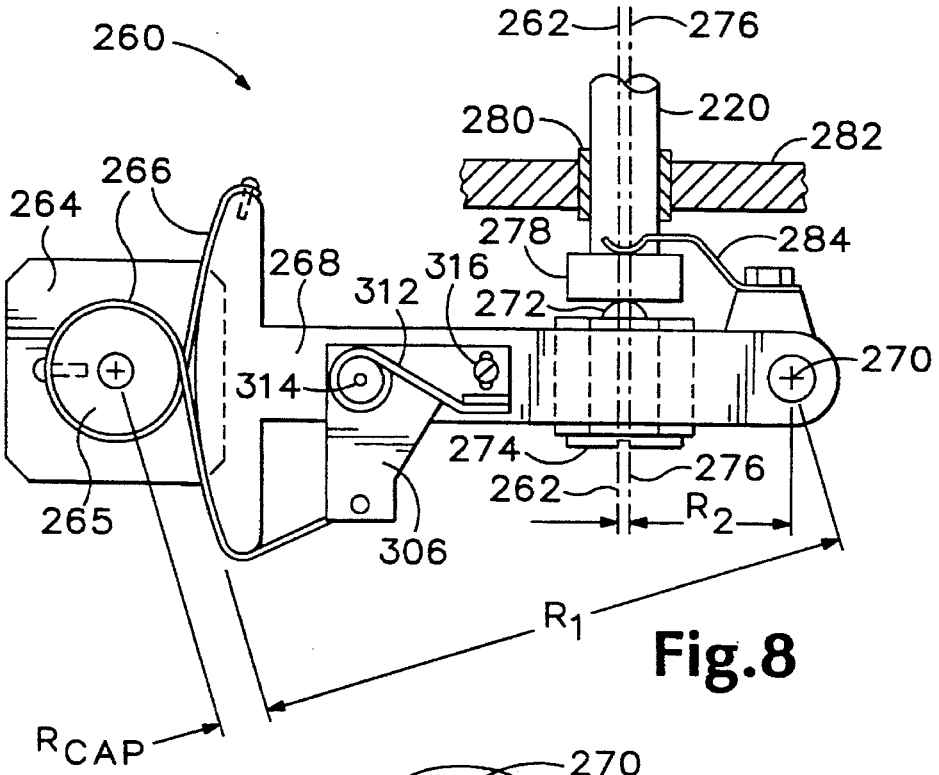
FIG. 8 is a top pictorial view showing the operative geometric relationships among a stepper motor, capstan, taut metal band, lever arm, and shaft employed by the print head lateral positioner of FIG. 7.

Referring to FIGS. 7 and 8, a print head lateral positioner 260 moves print head 216 incrementally along a longitudinal axis 262 of shaft 220. A stepper motor 264 is coupled by a capstan 265 and a taut metal band 266 (hereafter "band 266") to a lever arm 268 that rotates on a pivot shaft 270. Lever arm 268 includes a ball contact 272 mounted in an eccentric drive 274 such that a ball axis 276 is minutely positionable relative to longitudinal axis 262 by rotating eccentric drive 274. Rotationally angular increments of stepper motor 264 are converted to corresponding angular increments of lever arm 268 and thereby to corresponding lateral translational movements of shaft 220 by means of ball contact 272. The end of shaft 220 adjacent to lever arm 268 includes a hardened metal flat 278 that abuts ball contact 272. Shaft 220 slides in a shaft bearing 280 that is mounted in a mounting plate 282. A keeper spring 284 biases shaft 220 toward ball contact 272 to maintain contact therewith.

Figure 9:
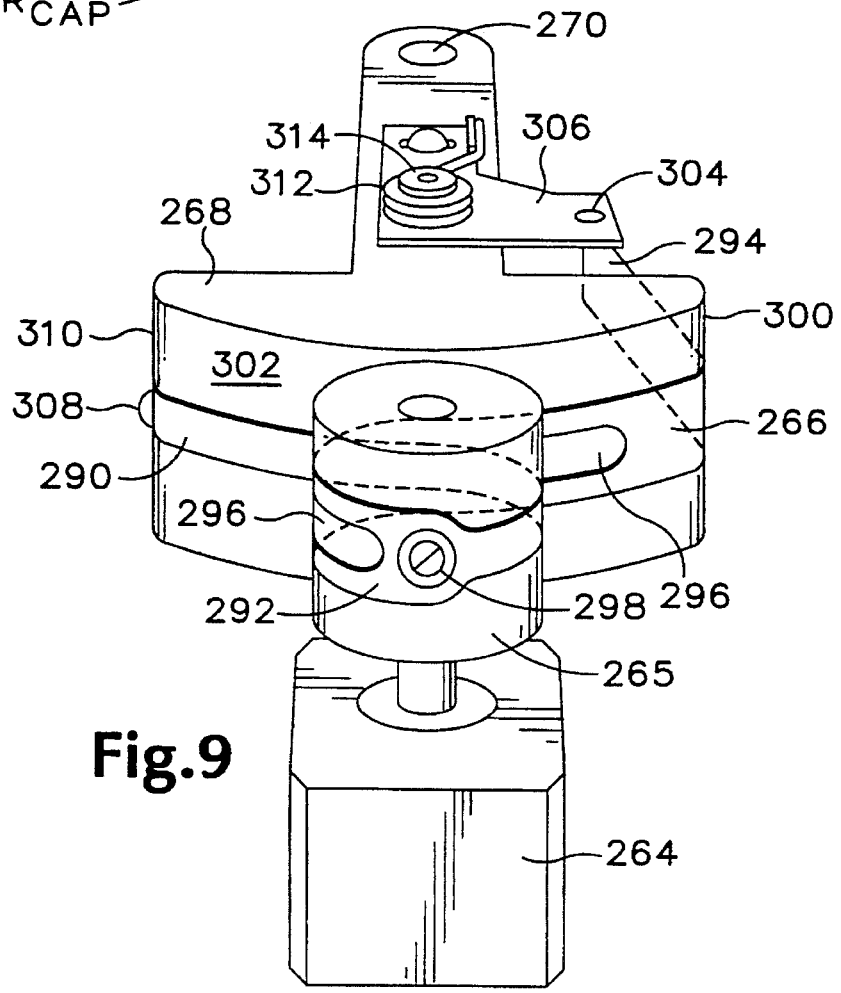
FIG. 9 is an isometric pictorial view of print head lateral positioner components of FIG. 8 showing how the taut metal band couples the stepper motor to the lever arm.

FIG. 9 shows how band 266 couples capstan 265 to lever arm 268.

Print head lateral positioner 260 is shown in its nominally centered position. However, a printing cycle normally begins with shaft 220 translated by lever arm 268 to a starting end of its travel that is associated with an index position. The index position may be detected by one of many conventional means, such as a microswitch or electro-optical sensor coupled to stepper motor 264, lever arm 268, shaft 220, or print head 216. The overall lateral travel distance of shaft 200 controlled by lateral positioner 260 is about 10 millimeters.

Referring again to FIG. 6, print head tilt angle positioner 258 performs multiple functions including maintaining head-to-image-receiving medium printing distance 256, guiding print head 216 parallel to axis of rotation 204 during imaging of drum 202, providing fine adjustment of a printing tilt angle 320, tilting print head 216 away from drum 202 to provide clearance for maintenance station 253, thermally isolating print head 216 from drum 202 during nonprinting periods, and tilting print head 216 away from drum 202 to provide a configuration resistant to shipping damage.

Because nozzle arrays 218 eject, respectively, yellow Y, magenta M, cyan C, and black K colored phase-change ink, and are spaced vertically, adjustability of printing tilt angle 320 relative to drum 202 provides precise relative adjustment of printing distance 256 for each of nozzle arrays 218 such that the ink drop transit time from each nozzle array to drum 202 is equalized to provide for the overlaying of different colored ink drops.

Figure 10:
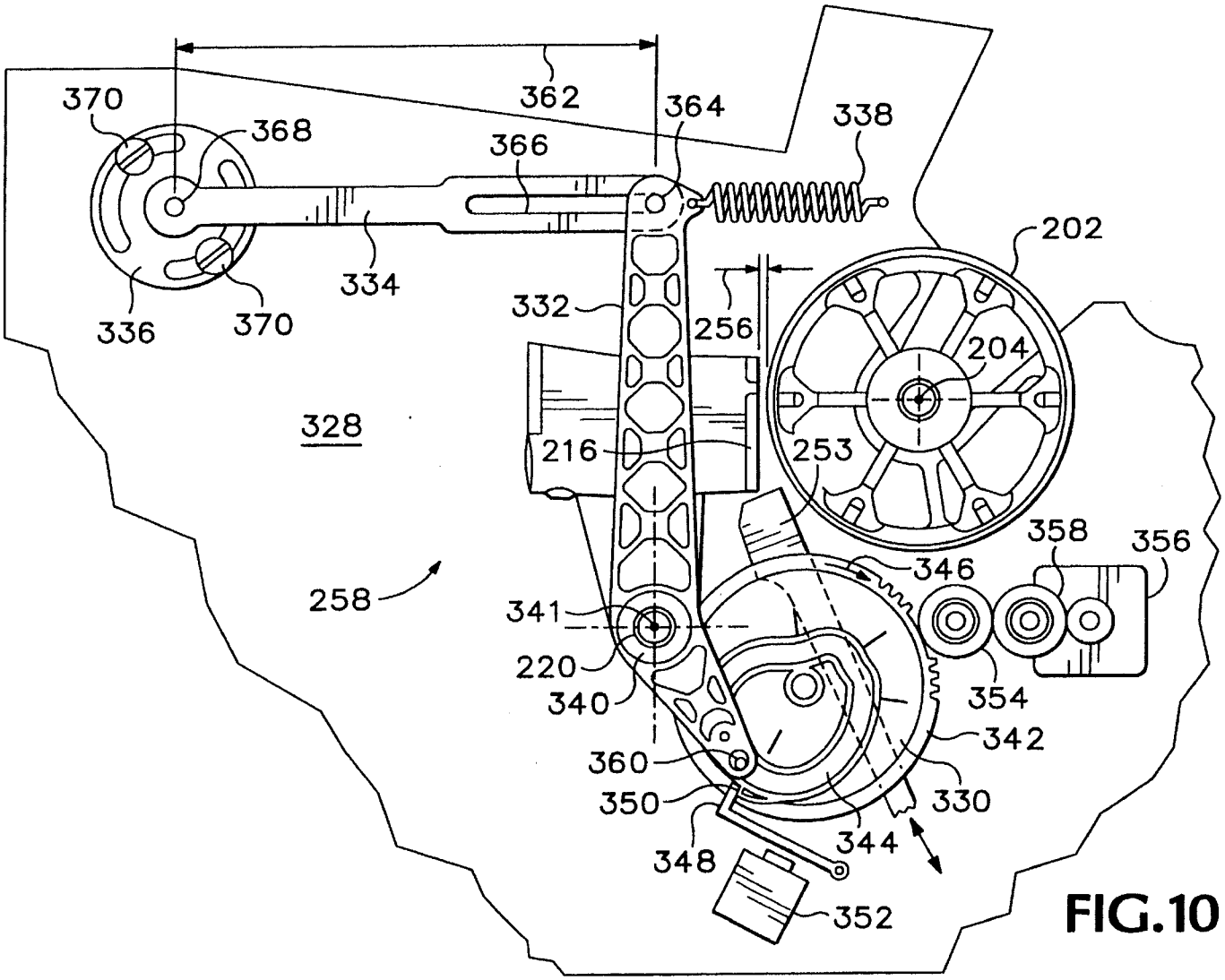
FIG. 10 is a left side elevation view of a print head tilt angle positioner according to this invention shown with the print head oriented at a printing tilt angle.
Figure 11:
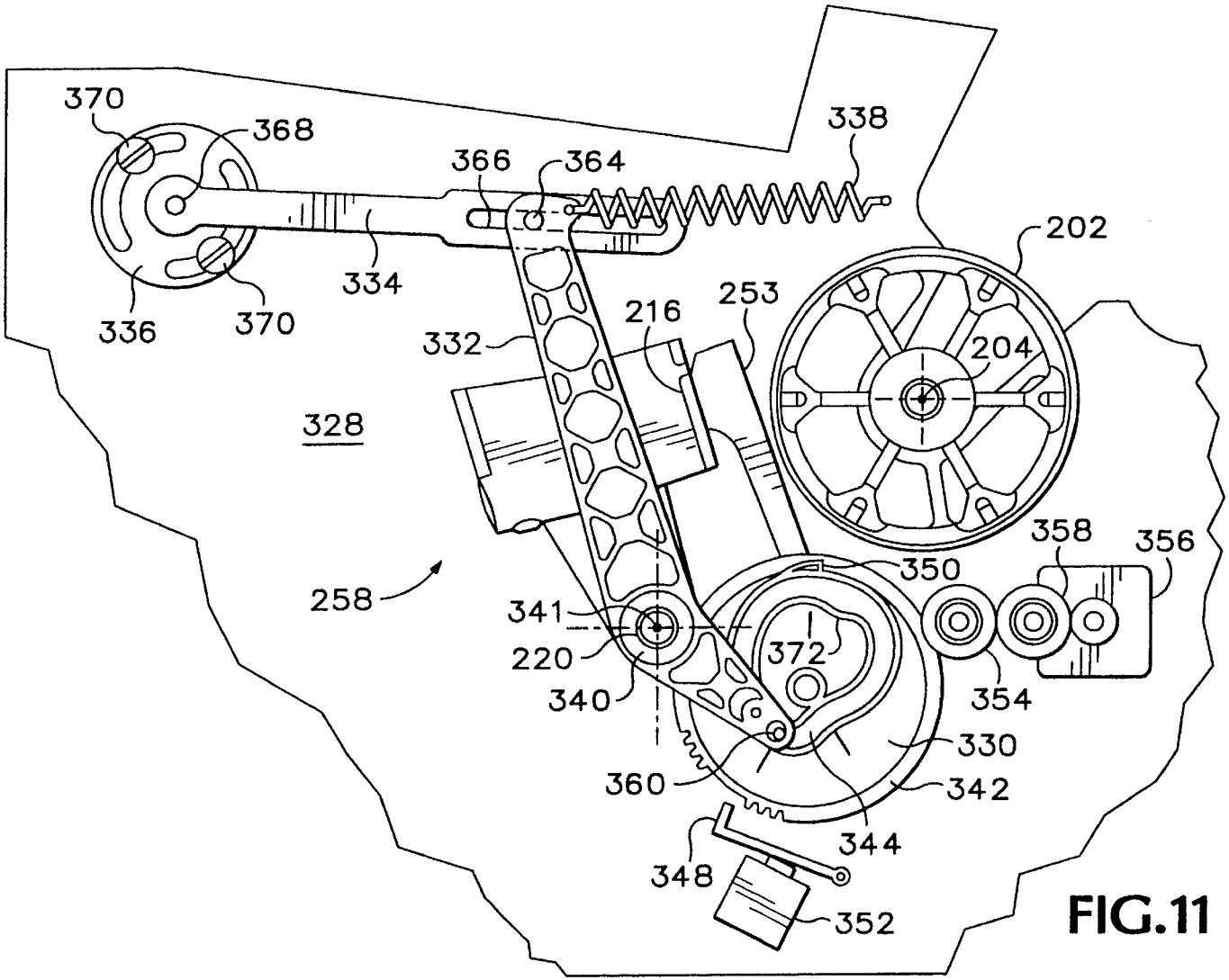
FIG. 11 is a left side elevation view of a print head tilt angle positioner according to this invention shown with the printhead at a maintenance tilt angle.

FIGS. 10 and 11 show a preferred embodiment of print head tilt angle positioner 258 oriented in respective printing and maintenance tilt angle positions. Print head maintenance station 253 is shown withdrawn in FIG. 10 and in contact with print head 216 in FIG. 11. The major components of tilt angle positioner 258 are mounted on a left side frame 328 (shown partly cut away) and include a gear-driven cam 330, a tilt arm 332, a flexure 334, a tilt angle adjuster 336, and a biasing spring 338. Tilt arm 332 is attached by a taper locking joint 340 to shaft 220 such that tilt arm 332 and print head 216 rotate together about a tilt axis of rotation 341 between printing and maintenance tilt angle positions. Shaft 220 rotates and slides laterally in shaft bearing 280 (FIG. 8), which is mounted in left side frame 328. Of course, shaft 200 rotates and slides in a similar shaft bearing mounted in a right side frame (not shown). Tilt axis of rotation 341 is parallel to drum axis of rotation 204.

Gear-driven cam 330 includes a missing-tooth gear 342 (only the missing tooth portion of the gear is shown) and a scroll cam 344. Gear-driven cam 330 is biased to rotate in a clockwise direction as indicated by an arrow 346, the biasing mechanism for which is described more fully with reference to FIG. 12. Missing-tooth gear 342 is held in the printing (disengaged) position shown in FIG. 10 by a trigger arm 348 abutting a stop 350 on the periphery of scroll cam 344.

Gear-driven cam 330 is actuated by energizing a solenoid 352 that pivots trigger arm 348 away from stop 350, thereby causing missing-tooth gear 342 to rotate into engagement with drive gear 354, which receives rotational power from a drive motor 356 and an idler gear 358. Drive motor 356 subsequently controls the rotation of gear-driven cam 330.

Attached to one end of tilt arm 332 is a follower 360 that rides inside scroll cam 344. Follower 360 is captive within scroll cam 344 over the entire 10-millimeter range of lateral motion of shaft 220. When gear-driven cam 330 rotates, scroll cam 344 guides follower 360 to provide controlled rotational motion of tilt arm 332 about tilt axis of rotation 341.

The print head tilt angle is controlled by scroll cam 344 in all positions except the printing tilt angle. At the printing tilt angle position, printing distance 256 is established by controllably limiting the clockwise rotation of tilt arm 332 with flexure 334. In particular, printing distance 256 is determined by the angular displacement of tilt arm 332 about tilt axis of rotation 341. The angular displacement of tilt arm 332 is regulated by the rotation of angular adjuster 336, which controls the relative positioning of fixed distance 362 with respect to drum surface 202. Fixed distance 362 is the distance between pivot 368 and position post 364. Post 364 slides in a slot 366 in flexure 334 for all positions except the printing tilt angle position, at which position post 364 abuts the end of slot 366, thereby limiting the rotation of tilt arm 332. Flexure 334 is attached to tilt angle adjuster 336 by a pivot 368 that is positioned eccentrically or off-center from the rotational axis of tilt angle adjuster 336. Distance 362, and thereby printing distance 256, is therefore adjusted by loosening set screws 370, rotating tilt angle adjuster 336 to the desired position, and tightening set screws 370. Pivot 368 is preferably off-centered by an amount such that each 10-degree rotational increment of tilt angle adjuster 336 changes printing distance 256 by about 0.0025 millimeter (0.001 inch).

Flexure 334 preferably has a length of about 6 inches, is stamped from stainless steel and is approximately 0.020 inches thick.

In the printing position, a relief 372 (FIG. 11) in scroll cam 344 disengages follower 360 from scroll cam 344 such that the printing position of tilt arm 332 is determined solely by distance 362. Thereby, in the printing position, the angle of tilt arm 332 is determined by flexure 334. Follower 360 is preferably eccentric and pivotally attached to tilt arm 332 such that in the adjusted printing position, follower 360 may be adjustably centered adjacent to relief 372 in scroll cam 344.

Flexure 334 is held in tension by biasing spring 338, which removes slack from the system and urges print head 216 toward drum 202 with a preferred force of about 2 pounds in the printing position. During printing, shaft 220 moves laterally such that flexure 334 bends back and forth as print head 216 traverses drum 202. Flexure 334 maintains printing distance 256 during printing with substantial parallism to drum axis of rotation 204 while enabling substantially frictionless lateral motion of print head 216.

As described above, taper locking joint 340 connects tilt arm 332 to shaft 220. The connection is infinitely adjustable to provide a secure joint for coarse head angle adjustment during assembly of tilt angle positioner 258. Fine adjustment of print head 216 tilt angle is accomplished as described above by tilt angle adjuster 336.

Figure 12:
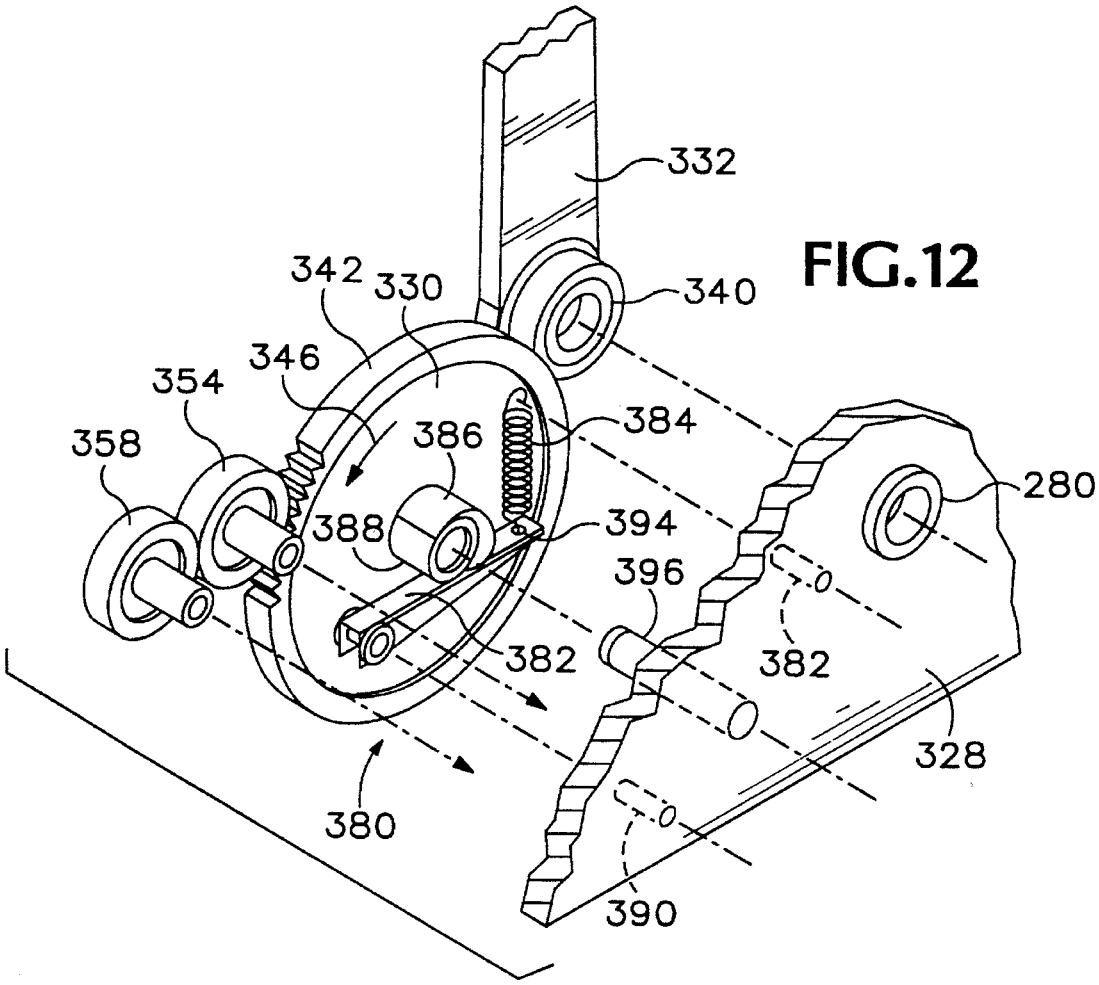
FIG. 12 is an exploded partial isometric right side view of the tilt angle positioner of FIGS. 10 and 11 showing a rotational biasing mechanism of a gear-driven cam of this invention.

FIG. 12 shows the right side of gear-driven cam 330, gears 354 and 358, and a portion of tilt arm 332 exploded apart from a fragment of left side frame 328 to reveal a rotational biasing assembly 380. Gear-driven cam 330 is shown in the printing position at which drive gear 354 is disengaged from missing-tooth gear 342. Rotational bias in direction 346 is developed by urging a lever 382 with a spring 384 to ride against a cam 386 that is positioned on a hub 388 of gear-driven cam 330. Note that lever 382 and spring 384 are attached to left side frame 328, not gear-driven cam 300 as it appears in FIG. 12. Cam 386 is positioned on hub 388 such that lever 384 and cam 386 apply rotational bias in direction 346 to gear-driven cam 330 when it is in the printing position. Rotational bias is necessary only to engage drive gear 354 with missing-tooth gear 342 when trigger arm 348 is disengaged from stop 350 (FIGS. 10, 11).

When assembled, lever 382 is rotationally secured to left side frame 328 by a post 390 (shown in dashed lines) and captured between washers and a E-ring clip (not shown). Spring 384 is suspended between a post 392 (shown in dashed lines) attached to left side frame 328 and a hole 394 in the free end of lever 382. Gear-driven cam 330 is rotationally secured to left side frame 328 by a post 396 (partly shown in dashed lines) and captured between side frame 328 and a E-ring clip (not shown). Shaft 220 (not shown) protrudes through shaft bearing 280 in left side frame 328 to mate with taper locking joint 340 on tilt arm 332. Gears 354 and 358 are rotationally secured to left side frame 328 in a manner similar to that of lever 382 and gear-driven cam 330.

Skilled workers will recognize that portions of this invention may have alternative embodiments. For example;

A conventional gear may replace missing-tooth gear 346, solenoid 352, trigger arm 348, and stop 350 if drive motor 356 is dedicated to only the task of rotationally positioning cam 330.

Alternatively, a single sided cam could replace the two sided scroll cam 344 if the return spring provides adequate counter rotational force. Similarly, arm 382 and spring 384 could be replaced with a cantilever leaf spring.

Also print head 216 may slide laterally and be controllably rotated on a fixed shaft with a connecting arm attached to the print head (all not shown). Lastly, combinations of lateral and rotational motion may be applied to shaft 220 to perform additional functions such as engaging a shipping lock, such as a spring-loaded push-twist-release type of lock to secure print head 216.

The dimensions and proportions of various combinations of the above-described components may be varied to suit particular application requirements.

It will be obvious to those having skill in the art that many changes may be made to the details of the above-described embodiments of this invention without departing from the underlying principles thereof. Accordingly, it will be appreciated that this invention is also applicable to precision positioning applications other than those found in phase-change ink-jet printers. The scope of the present invention should, therefore, be determined only by the following claims.

We claim:

1. In a printing apparatus having a print head and an image-receiving medium that move in respective first and second directions and in which the print head is spaced apart a desired distance from the image-receiving medium in a third direction, a print head positioner comprising in combination:

a shaft to which the print head is affixed, the shaft having an axis of rotation oriented in the first direction; and a print head tilt angle positioner that rotates the shaft about the axis of rotation to position the print head in the third direction at respective printing and maintenance positions relative to the image-receiving medium, the print head distance from the image-receiving medium being established by controllablly limiting rotation of a tilt arm with a coupling space apart from the shaft and slidingly articulated with a slot in an elongated flexure as the tilt arm moves through a range of angular positions to move the print head from shipping position to the printing and maintenance positions, the tilt arm being immovable in the slot in the printing position and the print head distance further being adjustable by movement of a selectively rotatable tilt angle adjuster.

2. The apparatus of claim 1 in which the first, second, and third directions are mutually orthogonal.

3. The apparatus of claim 1 in which the image-receiving medium is a drum.

4. The apparatus of claim 1 in which the print head is an ink-jet nozzle array type.

5. The apparatus of claim 4 in which the print head has first and second nozzles that are spaced apart in the second direction and in which the print head tilt angle positioner is adjustable to equalize a printing distance from the first and second nozzles to the image-receiving medium.

6. The apparatus of claim 1 in which the print head tilt angle positioner includes a tilt arm having a follower attached thereto that is spaced apart from the shaft, the follower being movable by a cam such that angular positions of the cam impart corresponding angular positions to the shaft.

7. The apparatus of claim 6 in which the cam imparts a particular angular position to the shaft that positions the print head in the maintenance position.

8. The apparatus of claim 7 in which a print head maintenance station is positioned between the print head and the image-receiving medium.

9. The apparatus of claim 1 further including the tilt angle adjuster and in which the elongated flexure has first and second ends, the end of the slot being adjacent to the second end and the tilt angle adjuster being attached to the first end such that a displacement of the tilt angle adjuster imparts a corresponding displacement to the end of the slot such that the printing angular position is adjustable to establish a printing distance in the third direction between the print head and the image-receiving medium.

10. The apparatus of claim 1 further including a biasing spring that urges the tilt arm toward the image-receiving medium, imparts a tension force to the elongated flexure, and removes slack from the print head tilt angle positioner.

11. The apparatus of claim 1 further including a print head lateral positioner that moves the shaft in the first direction.

12. The apparatus of claim 11 in which the flexure enables substantially frictionless operation of the print head lateral positioner while maintaining the printing angular position at a substantially constant angle.

13. The apparatus of claim 11 further including a shaft locking means that is engaged by a combination of a shaft lateral position and a shaft angular position to provide a shipping position for the printing apparatus.

14. The apparatus of claim 1 in which the tilt arm further includes a follower that is spaced apart from the shaft, the follower being movable by a cam such that angular positions of the cam impart the range of angular positions to the shaft.

15. The apparatus of claim 14 in which the cam and the follower are disengaged at the printing angular position.

16. A method of adjusting print head positioning apparatus in a printer having a print head and an image-receiving medium that move in respective first and second directions and in which the print head is spaced a desired distance apart from the image-receiving medium in third direction, the method of adjusting the print head positioning apparatus comprising the steps of:

providing a shaft having an axis of rotation oriented in the first direction;

affixing the print head to the shaft;

attaching a tilt arm to the shaft;

placing a coupling on the tilt arm at a predetermined spacing from the shaft;

providing an elongated flexure having a slot therein;

attaching the coupling to the flexure such that the coupling slides in the slot to controllably limit the rotation of the tilt arm;

moving the tilt arm through a range of angular positions to move the print head in the third direction to the desired distance from the image-receiving medium, the tilt arm being immovable in the slot at a printing position and movable in the slot for all other positions; and rotating the shaft about the axis of rotation to move the tilt arm to position the print head in the third direction at the respective printing and maintenance positions.

17. The method of claim 16 further including the step of providing a drum to serve as the image-receiving medium.

18. The method of claim 16 in which the print head is of an ink-jet type that has first and second nozzles spaced apart in the second direction, and in which the rotating step further includes the step of adjusting the printing position to equalize a printing distance from the first and second nozzles to the image-receiving medium.

19. The method of claim 16 in which the rotating step further includes the steps of:

attaching the tilt arm to the shaft;

placing a follower on the tilt arm at a predetermined spacing from the shaft; and moving the follower with a cam such that angular positions of the cam impart corresponding angular positions to the shaft.

20. The method of claim 19 in which the moving step entails imparting a particular angular position to the shaft that positions the print head in the maintenance position.

21. The method of claim 20 further including moving a print head maintenance station between the print head and the image-receiving medium.

22. The method of claim 16 in which the limiting step further includes:

providing a tilt angle adjuster;

attaching the tilt angle adjuster to an end of the flexure; and adjusting the tilt angle adjuster to impart a displacement to the end of the flexure such that the end of the slot is correspondingly displaced to establish a printing distance in the third direction between the print head and the image-receiving medium.

23. The method of claim 22 further including urging the tilt arm toward the image-receiving medium such that a tension force is imparted to the elongated flexure and slack is removed from the print head tilt angle positioner.

24. The method of claim 22 further including:

placing a follower on the tilt arm at a predetermined spacing from the shaft;

placing a cam in contact with the follower;

rotating the cam; and moving the follower with the cam such that angular positions of the cam impart the range of angular positions to the tilt arm.

25. The method of claim 24 further including disengaging the cam from the follower when the print head is at the printing position.

26. The method of claim 16 further including the step of moving the shaft in the first direction with a print head lateral positioner.

27. The method of claim 26 in which the flexure enables substantially frictionless motion of the shaft in the first direction while maintaining the printing distance at a substantially constant value.

28. The method of claim 26 further including the steps of:

providing a shaft locking mechanism;

moving the shaft a predetermined distance in the first direction;

rotating the shaft a predetermined angular amount; and moving the shaft a predetermined distance in a direction opposite to the first direction to engage the shaft locking mechanism.

* * * * *

UNITED STATES PATENT AND TRADEMARK OFFICE

CERTIFICATE OF CORRECTION

PATENT NO. : 5,608,430
DATED : March 4, 1997
INVENTOR(S) : Michael E. Jones and Randy C. Karambelas It is certified that error appears in the above-indentified patent and that said Letters Patent is hereby corrected as shown below:

Column 12, line 20, change "controllablly" to -- controllably --;

Column 12, line 21, change "space" to -- spaced --;

Column 13, line 19, after "in" and before "third" insert -- a --.

Signed and Sealed this

Tenth Day of June, 1997

*Attest:*

*Attesting Officer*

BRUCE LEHMAN

*Commissioner of Patents and Trademarks*